US012338710B1

(12) United States Patent
Gunasekaran

(10) Patent No.: US 12,338,710 B1
(45) Date of Patent: Jun. 24, 2025

(54) TUBING PRESSURE INSENSITIVE SAFETY VALVE WITH HYDROSTATIC COMPENSATION

(71) Applicant: Halliburton Energy Services, Inc., Houston, TX (US)

(72) Inventor: Mohan Gunasekaran, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 6 days.

(21) Appl. No.: 18/392,261

(22) Filed: Dec. 21, 2023

(51) Int. Cl.
*E21B 34/16* (2006.01)
*E21B 34/14* (2006.01)

(52) U.S. Cl.
CPC ..... *E21B 34/16* (2013.01); *E21B 34/14* (2013.01)

(58) Field of Classification Search
CPC ..... E21B 34/14; E21B 34/16
See application file for complete search history.

(56) References Cited

U.S. PATENT DOCUMENTS 4,467,867 A * 8/1984 Baker ..... E21B 49/001 166/308.4
10,920,529 B2 * 2/2021 Mailand ..... E21B 41/0021
12,180,807 B1 * 12/2024 Gassen ..... F16K 31/1225
2003/0094285 A1 * 5/2003 French ..... E21B 34/101 166/380
2008/0066921 A1 3/2008 Bane
2008/0110611 A1 5/2008 Bane
2015/0167427 A1 6/2015 Simpson
2016/0258254 A1 9/2016 Guo
2020/0056714 A1 * 2/2020 Mailand ..... E21B 34/14

OTHER PUBLICATIONS

ISR & Written Opinion in PCT/US2023/085948 mailed Sep. 11, 2024.

* cited by examiner

*Primary Examiner* — David Carroll
(74) *Attorney, Agent, or Firm* — The Hilton Firm PLLC

(57) ABSTRACT

Safety valves and methods of operating the same. An example safety valve includes a first piston disposed within a safety valve body. The first piston forms a first seal with the interior of the safety valve body. The first piston, the interior of the safety valve body, and the first seal define two chambers within the safety valve separated by the first seal. The first chamber is a control line pressure chamber disposed uphole of the first seal, and the second chamber is a fluid compression chamber disposed downhole of the first seal. The control line pressure chamber is pressurized to translate the first piston downhole in an axial direction. A second seal is formed with an annulus outside of and adjacent to the safety valve. A biasing mechanism translates the second piston uphole in the axial direction. A fluid volume chamber is fluidically connected to the fluid compression chamber.

20 Claims, 3 Drawing Sheets

TUBING PRESSURE INSENSITIVE SAFETY VALVE WITH HYDROSTATIC COMPENSATION

TECHNICAL FIELD

The present disclosure relates generally to wellbore operations, and more particularly, to the use of a safety valve that is tubing pressure insensitive and is configured to compensate for the hydrostatic pressure in the wellbore.

BACKGROUND

For some wellbore operations, it may be desirable to use a safety valve to prevent the uncontrolled release of wellbore fluids to the surface. Should surface or wellbore equipment suffer a failure, the fail-safe mechanism of the safety valve may force the safety valve closed, thereby preventing the uncontrolled release of wellbore fluids on the surface potentially leading to an environmental disaster and/or safety risks to wellbore personnel. Safety valves may be impacted by tubing pressure and/or the hydrostatic pressure in the wellbore.

Safety valves are an important part of wellbore operations. The present invention provides improved apparatus and methods for the use of a safety valve that is tubing pressure insensitive and is configured to compensate for the hydrostatic pressure in the wellbore.

BRIEF DESCRIPTION OF THE DRAWINGS

Illustrative examples of the present disclosure are described in detail below with reference to the attached drawing figures, which are incorporated by reference herein, and wherein.

Figure 1:
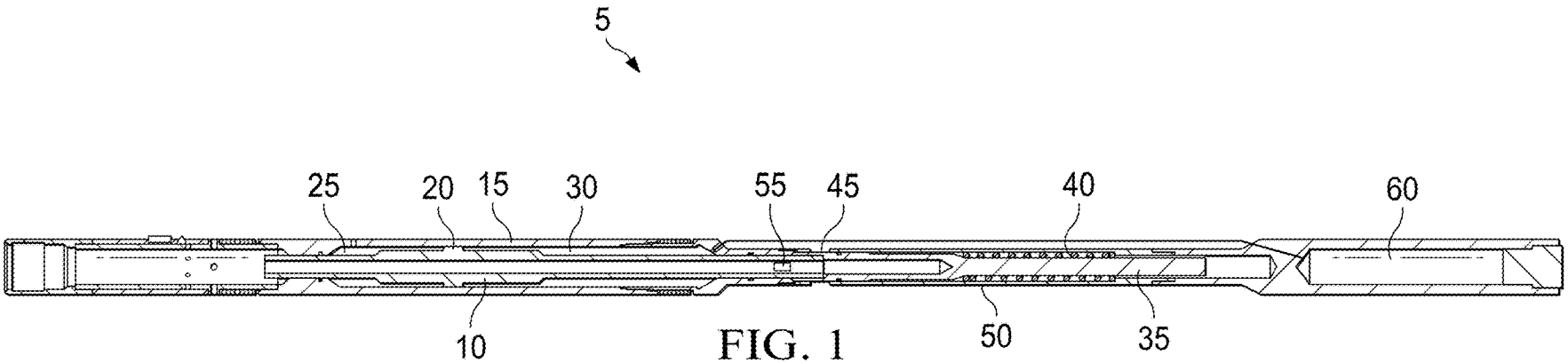
FIG. 1 is a schematic illustrating an example safety valve in accordance with one or more examples described herein.

The illustrated figures are only exemplary and are not intended to assert or imply any limitation with regard to the environment, architecture, design, or process in which different examples may be implemented.

DETAILED DESCRIPTION

The present disclosure relates generally to wellbore operations, and more particularly, to the use of a safety valve that is tubing pressure insensitive and is configured to compensate for the hydrostatic pressure in the wellbore.

In the following detailed description of several illustrative examples, reference is made to the accompanying drawings that form a part hereof, and in which is shown by way of illustration specific examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples are defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present invention. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

The terms upstream and downstream may be used to refer to the location of various components relative to one another in regards to the flow of a sample through said components. For example, a first component described as upstream from a second component will encounter a sample before the downstream second component encounters the sample. Similarly, a first component described as being downstream from a second component will encounter the sample after the upstream second component encounters the sample.

The present disclosure relates generally to wellbore operations, and more particularly, to the use of a safety valve that is tubing pressure insensitive and is configured to compensate for the hydrostatic pressure in the wellbore. Advantageously, the safety valve may be used in wellbores having high hydrostatic pressure by balancing the hydrostatic pressure with the use of a fluid compression chamber and a fluid volume chamber to compensate for the force of the hydrostatic pressure. Additionally, the safety valve is insensitive to tubing pressure as tubing pressure is balanced on both sides of the first piston. Thus, there is no effect on the control line pressure when opening the safety valve and also no effect on the biasing mechanism when closing the safety valve. An additional advantage is that once the tubing pressure is equalized, operation of the safety valve only requires overcoming the force of the biasing mechanism (e.g., a spring) and as such the safety valve may be opened with a limited amount of differential pressure applied from a single control line. As a further advantage, the fail-safe mechanism can be actuated by removal of the applied pressure from the control line. Removal of the applied control line pressure allows the biasing mechanism to close the valve, and the tubing pressure from below further assists in sealing the well pressure from below along with the force of the biasing mechanism. A further advantage is that the safety valve may be equipped to possess a radial flow inlet thereby providing the maximum flow-through area for the safety valve. One additional advantage is that the safety valve forms a metal-to-metal seal against an adjacent surface until it is opened to allow flow therethrough.

The safety valves disclosed herein may be installed in wellbore conduits and used within a variety of well sites including those comprising land or subsea well sites. The safety valves may be used in a variety of wellbores including, but not limited to, horizontal wellbores, vertical wellbores, deviated wellbores, and the like. The safety valves may be used with a variety of well types including, but not limited to, oil and gas wells, storage wells, geothermal wells, water wells, and the like.

FIG. 1 is a perspective figure illustrating a safety valve 5 for use in a wellbore. The safety valve 5 comprises a first piston 10 disposed within the body 15 of the safety valve 5. A protrusion seal 20 is formed from a raised element on the exterior of the first piston 10. This raised element may be a variable surface machined into the profile of the first piston 10 or may be a sealing element such as an o-ring or seal stack affixed to the exterior of the first piston 10. The first piston 10, the protrusion seal 20 on the interior of the safety valve body 15, and the interior surface of the safety valve body 15 define two chambers within the safety valve 5. These two chambers are separated by the protrusion seal 20. The first chamber is a control line pressure chamber 25 and is disposed uphole of the protrusion seal 20. The second chamber is a fluid compression chamber 30 and is disposed downhole of the protrusion seal 20.

As will be explained in greater detail below, the control line pressure chamber 25 may be pressurized with hydraulic fluid introduced via a single control line (not illustrated). Upon surpassing a desired pressure threshold, the pressurized hydraulic fluid translates the first piston downhole in the axial direction within the body 15 of the safety valve 5.

A second piston 35 is coupled to the first piston 10. The second piston 35 and the first piston 10 possess a linked motion such that movement of the first piston 10 also results in the movement of the second piston 35 in the same direction and at the same time. The second piston 35 comprises a biasing mechanism 40 to provide a biasing force to translate the second piston 35 uphole in the axial direction of the safety valve 5. The biasing mechanism 40 is illustrated as a spring, but any mechanism that biases the second piston 35 in the uphole direction with a sufficient force may be used. Examples of biasing mechanisms 40 may include, electrical, mechanical, hydraulic, and pneumatic mechanisms. The biasing mechanism 40 forces the safety valve 5 into the closed configuration which is the configuration in which the second piston 35 and the linked first piston 10 are positioned in their uphole default position. The tubing pressure acting on the tubing at the bottom of the wellbore also assists in keeping the safety valve 5 in the closed configuration. A metal-to-metal seal 45 is formed from the second piston 35 and the adjacent sleeve 50 to seal off the flow path through the safety valve 5 from the surrounding annulus (e.g., the wellbore annulus or casing annulus). To open the safety valve 5, the first piston 10 and the linked second piston 35 are forced to move downhole in the axial direction. This movement removes the metal-to-metal seal 45 and opens the interior of the safety valve 5 for fluid flow through the opening 55 in the safety valve 5 from the surrounding annulus.

In order to open the safety valve 5 for flow therethrough, the force of the tubing pressure on the safety valve 5 from downhole at the bottom of the tubing may be equalized. To equalize this force, a pressure may be applied on the tubing from above the safety valve 5, for example, at the wellhead to equalize the tubing pressure. The tubing may be pressured up by introducing a fluid into the tubing at a desired pressure. When the tubing pressure is equalized, the only force that must be overcome to open the safety valve 5 is the force provided by the biasing mechanism 40. This biasing mechanism 40 force may be overcome through the application of force from the pressurized hydraulic fluid introduced into the control line pressure chamber 25 as discussed above. Pressurized hydraulic fluid may be introduced into the control line pressure chamber 25 via a control line coupled to the safety valve 5. As the pressure in the control line pressure chamber 25 increases the first piston 10 and linked second piston 35 translate downhole in the axial direction. This translation of the linked pistons occurs when the pressurized fluid in the control line pressure chamber 25 generates a force sufficient to overcome that of the biasing mechanism 40.

As the first piston 10 and linked second piston 35 translate downhole in the axial direction, fluid within the fluid compression chamber 30 is compressed as the available volume in the fluid compression chamber 30 is reduced. The fluid in the fluid compression chamber 30 is a separate fluid from the fluid present in the control line pressure chamber 25 and these two fluids do not physically contact one another or intermingle. Examples of the fluid in the fluid compression chamber 30 may include, but are not limited to silicon oil and/or gases such as atmospheric air. The fluid in the fluid compression chamber 30 functions as a cushion to resist the force of the hydrostatic pressure on the safety valve 5 as well as to reduce uncontrolled movement of the first piston 10 and the second piston 35. As the fluid in the fluid compression chamber 30 is compressed, at least a portion of the fluid is ported to the fluid volume chamber 60. The fluid volume chamber 60 is configured to contain at least a portion of the fluid present in the fluid compression chamber 30. The fluid compression chamber 30 and the fluid volume chamber 60 are fluidically coupled such that a fluid may flow from one to the other. The fluid compression chamber 30 and the fluid volume chamber 60 may be fluidically connected via tubing or any other such fluid vessel sufficient for conveying a fluid from one chamber to the other and back.

When the safety valve 5 is in the open configuration, fluid from the surrounding annulus may enter the safety valve 5 through opening 55. Opening 55 is illustrated as a radial opening in the wall of the first piston 10. Other non-radial openings may be used for opening 55 in alternative embodiments. Opening 55 allows for fluid to enter the interior of the first piston 10 and to flow uphole via the connected upstream tubing and/or conduits to the wellsite surface.

When it is desired to close the safety valve 5, pressure may be cut to the control line supplying pressurized hydraulic fluid to the control line pressure chamber 25. When this pressure is released, the biasing mechanism 40 may translate the first piston 10 and the second piston 30 in the uphole direction to place the safety valve 5 in the closed configuration. Additionally, the applied pressure at the surface to equalize the tubing pressure may not need to be removed as the biasing mechanism 40 will close the safety valve 5. Once the safety valve is opened, the pressure from below and above the safety valve 5 is balanced and as such, there is no need to remove the tubing pressure applied from above.

The safety valve 5 may be installed in the wellbore with a wireline or other mechanism. In some examples, the safety valve may be retrievable with a wireline or with retrieval of the connecting tubing.

Figure 2:
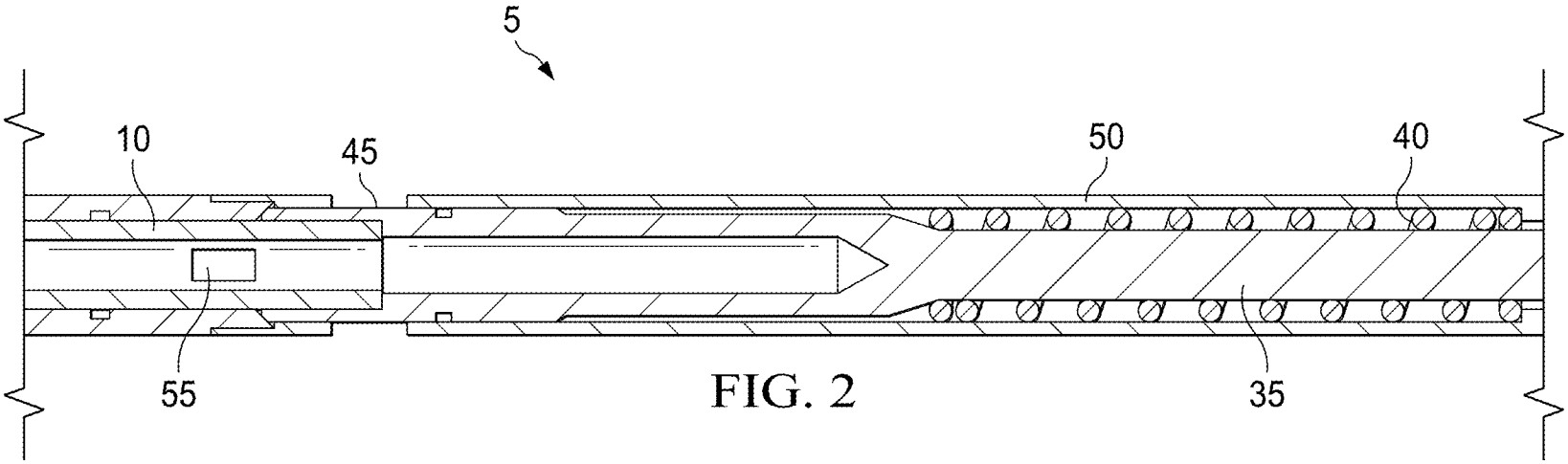
FIG. 2 is a schematic of an enlarged portion of the safety valve of FIG. 1 in accordance with one or more examples described herein.

FIG. 2 is a cross-section illustration of an enlarged portion of the safety valve 5 illustrated in FIG. 1. In the illustration of FIG. 2, the safety valve 5 is in its closed configuration and opening 55 is not aligned with the access port covered by the metal-to-metal seal 45 of the second piston 35 and the surrounding sleeve 50. The biasing mechanism 40, illustrated as a spring, has extended and first piston 10 and linked second piston 35 are shunted uphole as the force of the biasing mechanism 40 and the tubing pressure acting on the tubing are sufficient to overcome any force acting on the first piston 10 from the uphole direction. In order to open the safety valve 5, pressure from above the safety valve 5 can be applied to the tubing string to balance the tubing pressure acting on the tubing string at the downhole end of the tubing, for example, at the bottom hole assembly. This pressure from the surface may be applied at the wellhead through the introduction of a fluid into the tubing to pressure up the tubing such that a desired pressure is applied to the tubing. If an equal or near equal amount of pressure is applied to the safety valve 5 from uphole of the safety valve 5, the only force to overcome to open the safety valve 5 is the force applied by the biasing mechanism 40. As such, a differential pressure with an applied force greater than the biasing mechanism 40 may be supplied via a single control line to the control line pressure chamber (i.e., reference marker 25 as illustrated in FIG. 1) to pressurize the chamber and apply a force greater than that of the biasing mechanism 40 inducing translation of the first piston 10 and the second piston 35.

Figure 3:
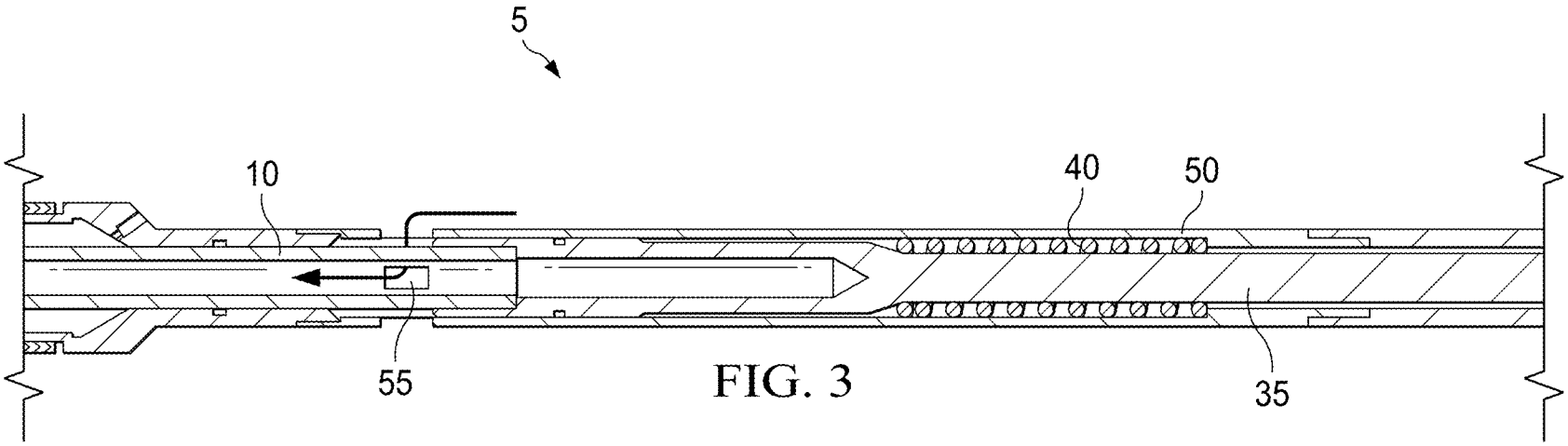
FIG. 3 is another schematic of an enlarged portion of the safety valve of FIG. 1 in accordance with one or more examples described herein.

FIG. 3 is a cross-section illustration of an enlarged portion of the safety valve 5 illustrated in FIG. 1. In the illustration of FIG. 3, the safety valve 5 is in its open configuration and opening 55 is now aligned with the access port that was previously covered by the metal-to-metal seal (i.e., reference marker 45 as illustrated in FIG. 2). The biasing mechanism 40, illustrated as a spring, has compressed and first piston 10 and linked second piston 35 are pushed downhole when the force of the biasing mechanism 40 is overcome by the force of the pressurized hydraulic fluid applied to the control line pressure chamber (i.e., reference marker as illustrated in FIG. 1). Translational movement in the downhole direction of the first piston and the second piston 35 aligns the opening 55 with the port previously blocked by the metal-to-metal seal (i.e., reference marker 45 in FIG. 2). Opening 55 is now configured to allow fluid flow from a surrounding annulus, such as the wellbore annulus, into the safety valve 5 via the opening 55 and the throughbore of the first piston 10.

To close the safety valve 5, the pressurized fluid pumped to the control line pressure chamber 25 may be cut, shifting the pressure differential in favor of the force applied by the biasing mechanism 40.

Figure 4:
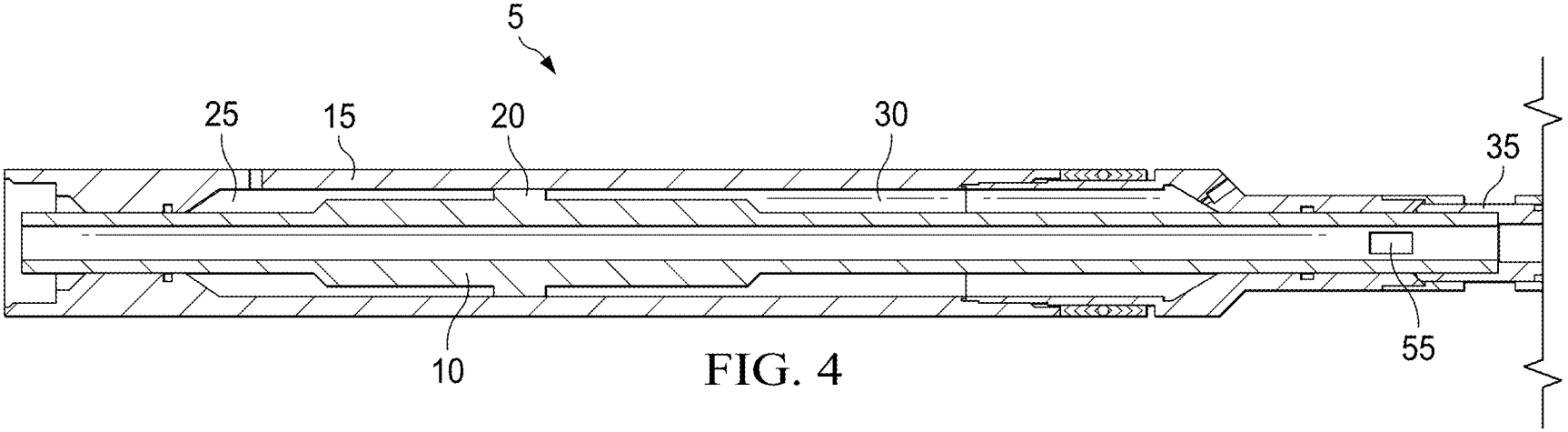
FIG. 4 is an additional schematic of an enlarged portion of the safety valve of FIG. 1 in accordance with one or more examples described herein.

FIG. 4 is a cross-section illustration of an enlarged portion of the safety valve 5 illustrated in FIG. 1. The illustration of FIG. 4, shows the two chambers formed within safety valve 5 by the boundary defined by the exterior of the first piston 10, the protrusion seal 20 on the interior of the safety valve body 15, and the interior surface of the safety valve body 15. The raised element forming the protrusion seal 20 extends from the exterior of the first piston to seal against the interior of the safety valve 15 to form two chambers on either side of the protrusion seal 20, the uphole chamber (i.e., the left-most chamber in the figure) is the control line pressure chamber 25. The downhole chamber (i.e., the right-most chamber in the figure) is the fluid compression chamber 30. A single control line is connected to the control line pressure chamber 25 via the illustrated port, or other sufficient connection, and a pressurized hydraulic fluid may be flowed to the control line pressure chamber 25 to create a differential pressure to overcome the force exerted by the biasing mechanism (i.e., reference marker 40 in FIG. 1). Pressurization of the control line pressure chamber 25 beyond this threshold will translate the first piston 10 in the axial direction resulting in the opening of the safety valve 5. The fluid compression chamber 30 is a separate chamber from the control line pressure chamber 25 and the fluid stored within is transported in the safety valve 5 as it is run-in-hole. This fluid is not pumped into the fluid compression chamber 30 once the safety valve 5 is deployed. The fluid within the fluid compression chamber 30 also does not contact or intermingle with the pressurized fluid within the control line pressure chamber 25. The fluid within the fluid compression chamber 30 functions as a cushion to resist pressure on the safety valve 5 as well as to reduce uncontrolled movement of the first piston 10 and the second piston 35. As the first piston 10 is pushed downhole the first piston 10 compresses the fluid within the fluid compression chamber 30 by decreasing the available volume within the fluid compression chamber 30. At least a portion of the now compressed fluid is ported to the fluid volume chamber (i.e., reference marker 60 in FIG. 1). The ported fluid may be conveyed to the fluid volume chamber 60 using a separate tubing, line, or even a flow path machined or otherwise formed within the bodies of the safety valve components, such as through the first piston 10 and the second piston 35 to link the two chambers.

Figure 5:
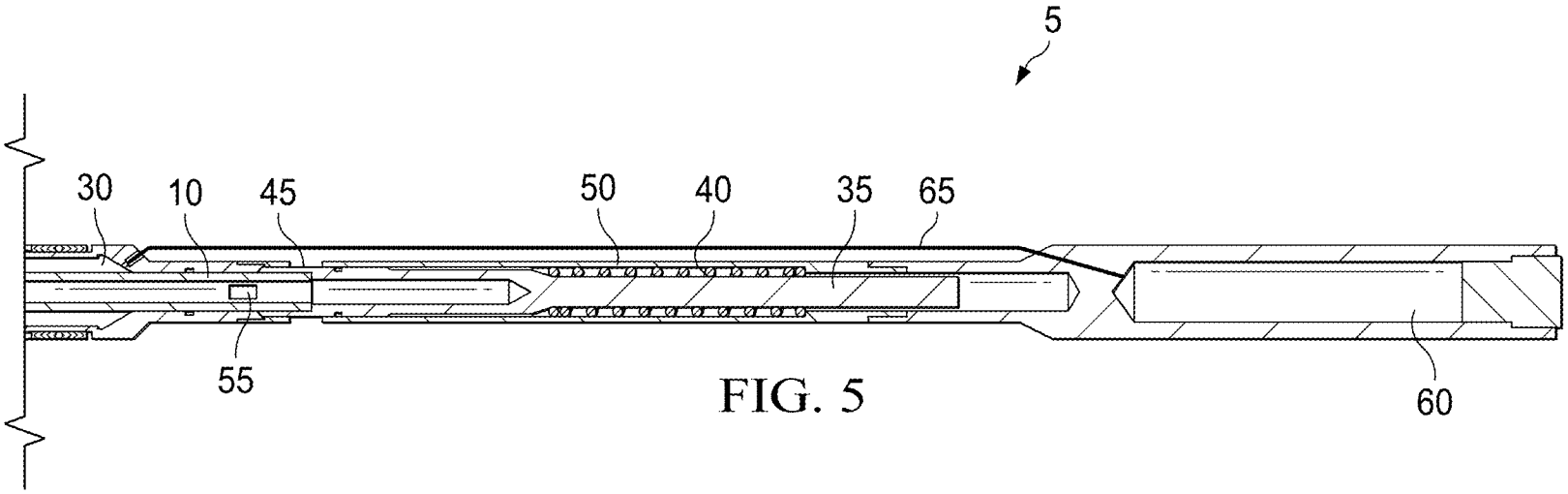
FIG. 5 is one more schematic of an enlarged portion of the safety valve of FIG. 1 in accordance with one or more examples described herein.

FIG. 5 is a cross-section illustration of an enlarged portion of the safety valve 5 illustrated in FIG. 1. The illustration of FIG. 5, shows an enlarged portion of the second piston and a portion of the fluid volume chamber 60. In the illustration, a separate line 65 is shown to fluidically connect the fluid volume chamber 60 with the fluid compression chamber 30. The fluid volume chamber 60 receives the compressed fluid from the fluid compression chamber to house it when the safety valve 5 is opened. The stored fluid may return to the fluid compression chamber 25 when the pressure to the control line pressure chamber (i.e., reference marker 25 in FIG. 1) is cut.

It should be clearly understood that the example system illustrated by FIGS. 1-5 is merely a general application of the principles of this disclosure in practice, and a wide variety of other examples are possible. Therefore, the scope of this disclosure is not limited in any manner to the details of FIGS. 1-5 as described herein.

The systems disclosed herein may directly or indirectly affect one or more components or pieces of equipment associated with or which may come into contact with the safety valves disclosed herein such as, but not limited to, wellbore casing, wellbore liner, completion string, insert strings, drill string, coiled tubing, slickline, wireline, drill pipe, drill collars, mud motors, downhole motors and/or pumps, cement pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like.

Provided is a safety valve for a wellbore in accordance with the disclosure and the illustrated FIGS. An example safety valve comprises a first piston disposed within a safety valve body. The safety valve body has an interior. The first piston forms a first seal with a surface of the interior of the safety valve body. The first piston, the interior of the safety valve body, and the first seal define two chambers within the safety valve. The two chambers are separated by the first seal. A first chamber of the two chambers is a control line pressure chamber and is disposed uphole of the first seal. A second chamber of the two chambers is a fluid compression chamber and is disposed downhole of the first seal. The control line pressure chamber is configured to be pressurized to translate the first piston downhole in an axial direction. The safety valve further comprises a second piston coupled to the first piston such that the two pistons comprise linked motion. The second piston forms a second seal with an annulus outside of and adjacent to the safety valve. The second piston comprises a biasing mechanism to provide a force to translate the second piston uphole in the axial direction. The safety valve is in a closed configuration when the second piston translates in the uphole direction. The safety valve is in an open configuration when the second piston translates in the downhole direction. The open configuration removes the second seal thereby allowing fluid flow from the annulus to an interior of the first piston. The safety valves also comprises a fluid volume chamber fluidically connected to the fluid compression chamber of the first piston.

Additionally or alternatively, the safety valve may include one or more of the following features individually or in combination. The first piston may comprise a radial opening such that removal of the second seal exposes the radial opening to the annulus. The biasing mechanism may comprise a spring. A connecting flow path may fluidically connect the volume chamber to the fluid compression chamber. The connecting flow path may be a flow line. The connecting flow path may at least partially comprise a flow path disposed through the body of the second piston. The volume chamber and the fluid compression chamber may be configured to contain a compressible fluid when the safety valve is conveyed into the wellbore. The safety valve may be tubing pressure insensitive. The safety valve may be configured to be installed with a wireline. The first seal may be formed by an o-ring or a seal stack.

Provided are methods for using a safety valve in accordance with the disclosure and the illustrated FIGS. An example method comprises providing a safety valve. The safety valve comprises a first piston disposed within a safety valve body. The safety valve body has an interior. The first piston forms a first seal with a surface of the interior of the safety valve body. The first piston, the interior of the safety valve body, and the first seal define two chambers within the safety valve. The two chambers are separated by the first seal. A first chamber of the two chambers is a control line pressure chamber and is disposed uphole of the first seal. A second chamber of the two chambers is a fluid compression chamber and is disposed downhole of the first seal. The control line pressure chamber is configured to be pressurized to translate the first piston downhole in an axial direction. The safety valve additionally comprises a second piston coupled to the first piston such that the two pistons comprise linked motion. The second piston forms a second seal with an annulus outside of and adjacent to the safety valve. The second piston comprises a biasing mechanism to provide a force to translate the second piston uphole in an axial direction. The safety valve is in a closed configuration when the second piston translates in the uphole direction. The safety valve is in an open configuration when the second piston translates in the downhole direction. The open configuration removes the second seal thereby allowing fluid flow from the annulus to the interior of the first piston. The safety valve additionally comprises a fluid volume chamber fluidically connected to the fluid compression chamber of the first piston.

The method additionally comprises applying tubing pressure to the safety valve from uphole, applying hydraulic pressure to the control line pressure chamber by pumping hydraulic fluid into the control line pressure chamber; wherein the applied hydraulic pressure is sufficient to overcome the force of the biasing mechanism thereby translating the second piston in the downhole direction to open the safety valve.

Additionally or alternatively, the method may include one or more of the following features individually or in combination. The first piston may comprise a radial opening such that removal of the second seal exposes the radial opening to the annulus. The biasing mechanism may comprise a spring. A connecting flow path may fluidically connect the volume chamber to the fluid compression chamber. The connecting flow path may be a flow line. The connecting flow path may at least partially comprise a flow path disposed through the body of the second piston. The volume chamber and the fluid compression chamber may be configured to contain a compressible fluid when the safety valve is conveyed into the wellbore. The safety valve may be tubing pressure insensitive. The safety valve may be configured to be installed with a wireline. The first seal may be formed by an o-ring or a seal stack. The method may further comprise removing the applied hydraulic pressure; wherein the removal of the applied hydraulic pressure allows the biasing mechanism to close the safety valve. The volume chamber and the fluid compression chamber may contain a compressible fluid and applying hydraulic pressure to the control line pressure chamber translates the first piston in the downhole direction and compresses the compressible fluid in the fluid compression chamber. At least a portion of the compressible fluid may be ported to the fluid volume chamber. The compressible fluid may comprise silicon oil or atmospheric air.

Provided are systems for operating a safety valve in a wellbore in accordance with the disclosure and the illustrated FIGS. An example system comprises a safety valve. The safety valve comprises a first piston disposed within a safety valve body. The safety valve body has an interior. The first piston forms a first seal with a surface of the interior of the safety valve body. The first piston, the interior of the safety valve body, and the first seal define two chambers within the safety valve. The two chambers are separated by the first seal. A first chamber of the two chambers is a control line pressure chamber and is disposed uphole of the first seal. A second chamber of the two chambers is a fluid compression chamber and is disposed downhole of the first seal. The control line pressure chamber is configured to be pressurized to translate the first piston downhole in an axial direction. The safety valve further comprises a second piston coupled to the first piston such that the two pistons comprise linked motion. The second piston forms a second seal with an annulus outside of and adjacent to the safety valve. The second piston comprises a biasing mechanism to provide a force to translate the second piston uphole in an axial direction. The safety valve is in a closed configuration when the second piston translates in the uphole direction. The safety valve is in an open configuration when the second piston translates in the downhole direction. The open configuration removes the second seal thereby allowing fluid flow from the annulus to the interior of the first piston. The safety valve further comprises a fluid volume chamber fluidically connected to the fluid compression chamber of the first piston. The system additionally comprises a conduit to which the safety valve is installed.

Additionally or alternatively, the system may include one or more of the following features individually or in combination. The system may further comprise a control line coupled to the safety valve and fluidically connected with the control line pressure chamber. The control line may be a single control line and wherein the safety valve is not coupled to another control line. The first piston may comprise a radial opening such that removal of the second seal exposes the radial opening to the annulus. The biasing mechanism may comprise a spring. A connecting flow path may fluidically connect the volume chamber to the fluid compression chamber. The connecting flow path may be a flow line. The connecting flow path may at least partially comprise a flow path disposed through the body of the second piston. The volume chamber and the fluid compression chamber may be configured to contain a compressible fluid when the safety valve is conveyed into the wellbore. The safety valve may be tubing pressure insensitive. The safety valve may be configured to be installed with a wireline. The first seal may be formed by an o-ring or a seal stack.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of or "consist of the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A safety valve for a wellbore comprising:

a first piston disposed within a safety valve body, the safety valve body having an interior; wherein the first piston forms a first seal with a surface of the interior of the safety valve body; wherein the first piston, the interior of the safety valve body, and the first seal define two chambers within the safety valve; wherein the two chambers are separated by the first seal; wherein a first chamber of the two chambers is a control line pressure chamber and is disposed uphole of the first seal; wherein a second chamber of the two chambers is a fluid compression chamber and is disposed downhole of the first seal; wherein the control line pressure chamber is configured to be pressurized to translate the first piston downhole in an axial direction;

a second piston coupled to the first piston such that the two pistons comprise linked motion; wherein the second piston forms a second seal with a sleeve to seal off an annulus outside of and adjacent to the safety valve; wherein the second piston comprises a biasing mechanism to provide a force to translate the second piston uphole in the axial direction; wherein the safety valve is in a closed configuration when the second piston translates in the uphole direction; wherein the safety valve is in an open configuration when the second piston translates in the downhole direction; wherein the open configuration removes the second seal thereby allowing fluid flow from the annulus to an interior of the first piston;

a fluid volume chamber fluidically connected to the fluid compression chamber of the first piston.

2. The safety valve of claim 1, wherein the first piston comprises a radial opening such that removal of the second seal exposes the radial opening to the annulus.

3. The safety valve of claim 1, wherein the biasing mechanism is a spring.

4. The safety valve of claim 1, wherein a connecting flow path fluidically connects the volume chamber to the fluid compression chamber.

5. The safety valve of claim 4, wherein the connecting flow path is a flow line.

6. The safety valve of claim 4, wherein the connecting flow path at least partially comprises a flow path disposed through the body of the second piston.

7. The safety valve of claim 1, wherein the volume chamber and the fluid compression chamber are configured to contain a compressible fluid when the safety valve is conveyed into the wellbore.

8. The safety valve of claim 1, wherein the safety valve is tubing pressure insensitive.

9. The safety valve of claim 1, wherein the safety valve is configured to be installed with a wireline.

10. The safety valve of claim 1, wherein the first seal is formed by an o-ring or a seal stack.

11. A method for operating a safety valve, the method comprises:

providing a safety valve comprising:

a first piston disposed within a safety valve body, the safety valve body having an interior; wherein the first piston forms a first seal with a surface of the interior of the safety valve body; wherein the first piston, the interior of the safety valve body, and the first seal define two chambers within the safety valve; wherein the two chambers are separated by the first seal; wherein a first chamber of the two chambers is a control line pressure chamber and is disposed uphole of the first seal; wherein a second chamber of the two chambers is a fluid compression chamber and is disposed downhole of the first seal; wherein the control line pressure chamber is configured to be pressurized to translate the first piston downhole in an axial direction;

a second piston coupled to the first piston such that the two pistons comprise linked motion; wherein the second piston forms a second seal with a sleeve to seal off an annulus outside of and adjacent to the safety valve; wherein the second piston comprises a biasing mechanism to provide a force to translate the second piston uphole in an axial direction; wherein the safety valve is in a closed configuration when the second piston translates in the uphole direction; wherein the safety valve is in an open configuration when the second piston translates in the downhole direction; wherein the open configuration removes the second seal thereby allowing fluid flow from the annulus to the interior of the first piston;

a fluid volume chamber fluidically connected to the fluid compression chamber of the first piston;

applying tubing pressure to the safety valve from uphole;

applying hydraulic pressure to the control line pressure chamber by pumping hydraulic fluid into the control line pressure chamber; wherein the applied hydraulic pressure is sufficient to overcome the force of the biasing mechanism thereby translating the second piston in the downhole direction to open the safety valve.

12. The method of claim 11, further comprising:

removing the applied hydraulic pressure; wherein the removal of the applied hydraulic pressure allows the biasing mechanism to close the safety valve.

13. The method of claim 11, wherein the volume chamber and the fluid compression chamber contain a compressible fluid; wherein applying hydraulic pressure to the control line pressure chamber translates the first piston in the downhole direction and compresses the compressible fluid in the fluid compression chamber.

14. The method of claim 13, wherein at least a portion of the compressible fluid is ported to the fluid volume chamber.

15. The method of claim 13, wherein the compressible fluid comprises silicon oil or atmospheric air.

16. A system for operating a safety valve, the system comprising:

a safety valve comprising:

a first piston disposed within a safety valve body, the safety valve body having an interior; wherein the first piston forms a first seal with a surface of the interior of the safety valve body; wherein the first piston, the interior of the safety valve body, and the first seal define two chambers within the safety valve; wherein the two chambers are separated by the first seal; wherein a first chamber of the two chambers is a control line pressure chamber and is disposed uphole of the first seal; wherein a second chamber of the two chambers is a fluid compression chamber and is disposed downhole of the first seal; wherein the control line pressure chamber is configured to be pressurized to translate the first piston downhole in an axial direction;

a second piston coupled to the first piston such that the two pistons comprise linked motion; wherein the second piston forms a second seal with a sleeve to seal off an annulus outside of and adjacent to the safety valve; wherein the second piston comprises a biasing mechanism to provide a force to translate the second piston uphole in an axial direction; wherein the safety valve is in a closed configuration when the second piston translates in the uphole direction; wherein the safety valve is in an open configuration when the second piston translates in the downhole direction; wherein the open configuration removes the second seal thereby allowing fluid flow from the annulus to the interior of the first piston;

a fluid volume chamber fluidically connected to the fluid compression chamber of the first piston; and a conduit to which the safety valve is installed.

17. The system of claim 16, further comprising a control line coupled to the safety valve and fluidically connected with the control line pressure chamber.

18. The system of claim 17, wherein the control line is a single control line and wherein the safety valve is not coupled to another control line.

19. The system of claim 16, wherein the first piston comprises a radial opening such that removal of the second seal exposes the radial opening to the annulus.

20. The system of claim 16, wherein the volume chamber and the fluid compression chamber are configured to contain a compressible fluid when the safety valve is conveyed into the wellbore from a surface.

* * * * *